US008787784B2

(12) United States Patent
Miyamoto et al.

(10) Patent No.: US 8,787,784 B2
(45) Date of Patent: Jul. 22, 2014

(54) IMAGE FORMING APPARATUS AND IMAGE FORMING METHOD FOR ADJUSTING VOLTAGE APPLIED TO A TRANSFER UNIT

(75) Inventors: Yoko Miyamoto, Kanagawa (JP); Yasuhiro Funayama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 323 days.

(21) Appl. No.: 13/216,917

(22) Filed: Aug. 24, 2011

(65) Prior Publication Data

US 2012/0189335 A1 Jul. 26, 2012

(30) Foreign Application Priority Data

Jan. 20, 2011 (JP) ..... 2011-010276

(51) Int. Cl.
*G03G 15/16* (2006.01)

(52) U.S. Cl.
USPC ..... 399/66; 399/314

(58) Field of Classification Search
CPC ..... G03G 15/1675
USPC ..... 399/45, 66, 310, 313, 314
See application file for complete search history.

(56) References Cited

U.S. PATENT DOCUMENTS 5,774,762 A * 6/1998 Takemoto et al. ..... 399/66
6,347,209 B1 * 2/2002 Bessho
2004/0213598 A1 * 10/2004 Mori et al.
2010/0232820 A1 * 9/2010 Usami et al. ..... 399/66
2012/0045237 A1 * 2/2012 Aoki et al. ..... 399/66

FOREIGN PATENT DOCUMENTS

JP 5-307305 A 11/1993
JP 10-268590 A 10/1998
JP 2002-323801 A 11/2002
JP 2004-334017 A 11/2004
JP 2010008494 A * 1/2010

* cited by examiner

*Primary Examiner* — David Gray
*Assistant Examiner* — Laura Roth
(74) *Attorney, Agent, or Firm* — Sughrue Mion, PLLC

(57) ABSTRACT

An image forming apparatus includes an image carrier, a transfer unit, an applying unit, a detector, an acquisition unit, and an adjusting unit. The image carrier carries a toner image obtained by developing an electrostatic latent image using toner. The transfer unit transfers the toner image from the image carrier to a recording medium. The applying unit applies a voltage to the transfer unit. The detector detects a current being made to flow in the transfer unit. The acquisition unit acquires the image density of the toner image to be transferred in the transfer unit. The adjusting unit adjusts a voltage to be applied to the applying unit on the basis of a change in the relationship between the current detected by the detector and the image density acquired by the acquisition unit.

10 Claims, 5 Drawing Sheets

IMAGE FORMING APPARATUS AND IMAGE FORMING METHOD FOR ADJUSTING VOLTAGE APPLIED TO A TRANSFER UNIT

CROSS-REFERENCE TO RELATED APPLICATIONS

This application is based on and claims priority under 35 USC 119 from Japanese Patent Application No. 2011-010276 filed Jan. 20, 2011.

BACKGROUND

The present invention relates to an image forming apparatus and an image forming method.

SUMMARY

According to an aspect of the invention, there is provided an image forming apparatus including an image carrier, a transfer unit, an applying unit, a detector, an acquisition unit, and an adjusting unit. The image carrier carries a toner image obtained by developing an electrostatic latent image using toner. The transfer unit transfers the toner image from the image carrier to a recording medium. The applying unit applies a voltage to the transfer unit. The detector detects a current being made to flow in the transfer unit. The acquisition unit acquires the image density of the toner image to be transferred in the transfer unit. The adjusting unit adjusts a voltage to be applied to the applying unit on the basis of a change in the relationship between the current detected by the detector and the image density acquired by the acquisition unit.

BRIEF DESCRIPTION OF THE DRAWINGS

Exemplary embodiment(s) of the present invention will be described in detail based on the following figures, wherein.

DETAILED DESCRIPTION

An image forming apparatus according to an exemplary embodiment of the invention will be explained below with reference to the attached drawings.

Overall Configuration

Figure 1:
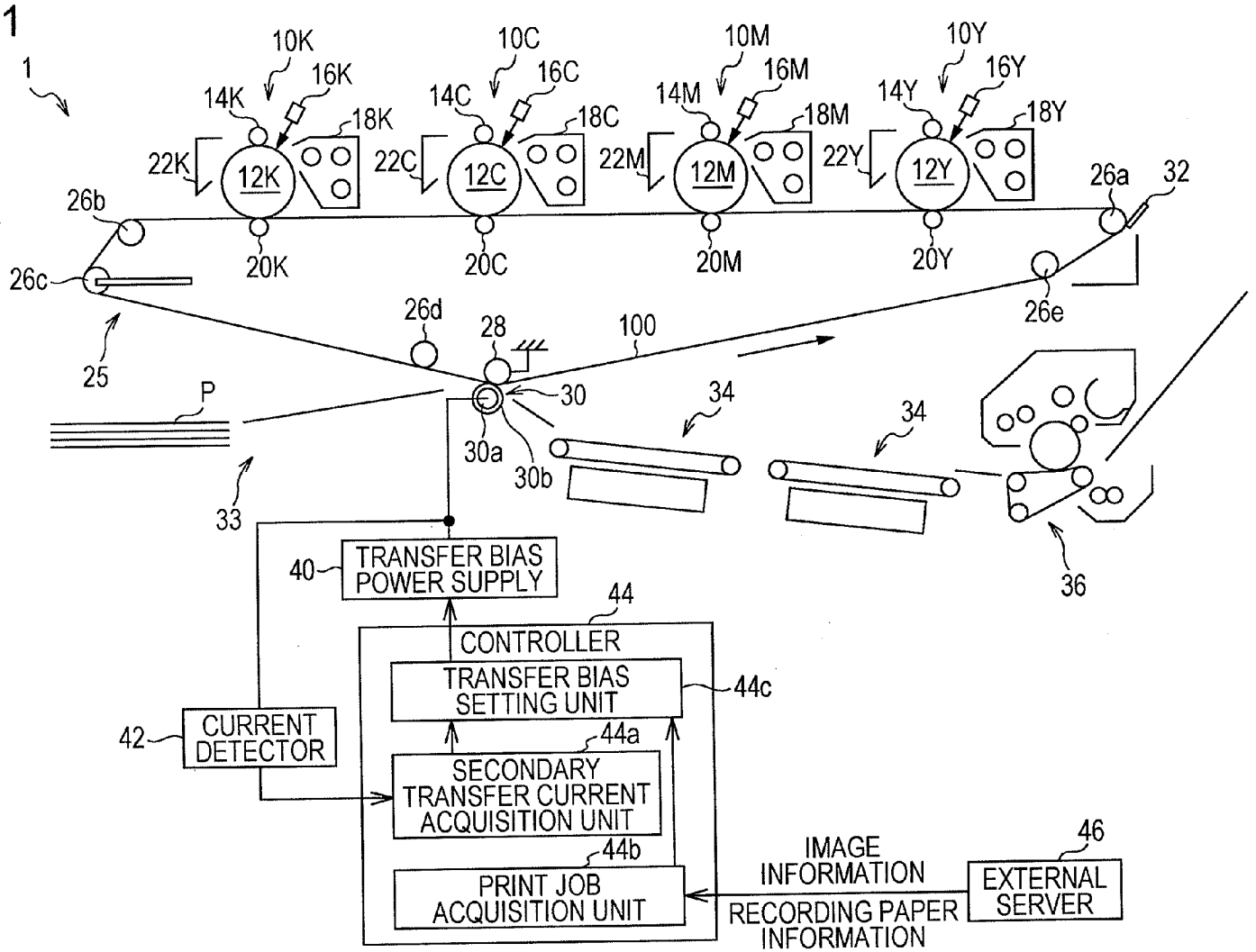
FIG. 1 is a schematic diagram showing the overall configuration of an image forming apparatus according to an exemplary embodiment of the invention.

FIG. 1 illustrates an example of the configuration of an image forming apparatus according to an exemplary embodiment of the invention.

An image forming apparatus 1 according to the exemplary embodiment includes image forming units 10Y for yellow (Y), 10M for magenta (M), 10C for cyan (C), and 10K for black (K). The image forming units 10Y, 10M, 10C, and 10K include photoreceptor drums 12Y, 12M, 12C, and 12K, respectively. The image forming units 10Y, 10M, 10C, and 10K also include charging devices 14Y, 14M, 14C, and 14K, exposing devices 16Y, 16M, 16C, and 16K, developing devices 18Y, 18M, 18C, and 18K, first transfer rolls 20Y, 20M, 20C, and 20K, and photoreceptor drum cleaners 22Y, 22M, 22C, and 22K, around the photoreceptor drums 12Y, 12M, 12C, and 12K, respectively. The charging devices 14Y, 14M, 14C, and 14K cause the surfaces of the photoreceptor drums 12Y, 12M, 12C, and 12K to be charged, respectively. The exposing devices 16Y, 16M, 16C, and 16K form electrostatic latent images on the surfaces of the charged photoreceptor drums 12Y, 12M, 12C, and 12K, respectively. The developing devices 18Y, 18M, 18C, and 18K develop the electrostatic latent images formed on the surfaces of the photoreceptor drums 12Y, 12M, 12C, and 12K into toner images using toner contained in developer, respectively. The first transfer rolls 20Y, 20M, 20C, and 20K perform first transfer of the toner images onto a transfer belt 100, which is an example of an image carrier. The photoreceptor drum cleaners 22Y, 22M, 22C, and 22K remove residual toner adhered to the surfaces of the photoreceptor drums 12Y, 12M, 12C, and 12K, respectively, after transfer is performed.

The transfer belt 100 is arranged so as to face the image forming units 10Y, 10M, 10C, and 10K. The transfer belt 100 is arranged between the photoreceptor drums 12Y, 12M, 12C, and 12K and the first transfer rolls 20Y, 20M, 20C, and 20K. First transfer currents for generating electric fields between the photoreceptor drums 12Y, 12M, 12C, and 12K and the transfer belt 100 are made to flow in the first transfer rolls 20Y, 20M, 20C, and 20K.

The transfer belt 100 is rotatably supported (extended in a tensioned state) by a driving roll 26*a*, a tension/steering roll 26*c* for preventing the transfer belt 100 from warping or meandering, support rolls 26*b*, 26*d*, and 26*e*, and a backup roll 28, while being placed under tension from the inner circumference side. Accordingly, the plural rolls 26*a*, 26*b*, 26*c*, 26*d*, and 26*e* for supporting the transfer belt 100 in a tensioned state and a motor (not illustrated) for rotating the driving roll 26*a* form a belt-driving device 25.

A secondary transfer roll 30 is arranged near the transfer belt 100 so as to face the backup roll 28 with the transfer belt 100 therebetween. As illustrated in FIG. 1, the backup roll 28 is earthed. The secondary transfer roll 30 is formed by adhering a semiconductive elastic material (for example, a semiconductive sponge) 30*b* around the periphery of a conductive mandrel 30*a*. A transfer bias power supply 40, which is an example of an applying unit, is electrically connected to the mandrel 30*a* so that a secondary transfer voltage can be applied to the secondary transfer roll 30. A current detector 42, which is an example of a detector, is electrically connected between the mandrel 30*a* and the transfer bias power supply 40, so that the secondary transfer current being made to flow in the secondary transfer roll 30 can be detected. The transfer bias power supply 40 and the current detector 42 are electrically connected to a controller 44.

The controller 44 includes a secondary transfer current acquisition unit 44*a*, a print JOB acquisition unit 44*b*, which is an example of an acquisition unit, and a transfer bias setting unit 44*c*, which is an example of an adjusting unit. The secondary transfer current acquisition unit 44*a* acquires a signal representing a secondary transfer current detected by the current detector 42, and transmits the acquired signal to the transfer bias setting unit 44*c*. The print JOB acquisition unit 44*b* is electrically connected to an external server 46. The print JOB acquisition unit 44*b* acquires a print JOB (more specifically, information on an image to be printed and information indicating on which type of recording paper the image is to be printed) transmitted from the external server 46, and transmits the acquired print JOB to the transfer bias setting unit 44*c*. The transfer bias setting unit 44*c* performs setting and adjustment of the secondary transfer voltage on the basis of the received data of the secondary transfer current and the print JOB, and transmits to the transfer bias power supply 40 a signal indicating the secondary transfer voltage to be applied to the secondary transfer roll 30. More detailed explanation will be provided below.

A belt cleaner 32 is arranged downstream from the secondary transfer roll 30 in the rotating direction of the transfer belt 100 (the direction indicated by the arrow in FIG. 1). The belt cleaner 32 removes toner remaining on the periphery of the transfer belt 100.

A paper-feeding device 33, a conveying device 34, and a fixing device 36 are arranged near the secondary transfer roll 30. The paper-feeding device 33 conveys and supplies recording paper P, which is an example of a recording medium, to the secondary transfer roll 30. The conveying device 34 conveys the recording paper P that has been subjected to secondary transfer by the secondary transfer roll 30. The fixing device 36 is arranged downstream from the conveying device 34 in the conveying direction and fixes a toner image transferred onto the recording paper P.

Regarding the image forming apparatus 1 according to the exemplary embodiment, in the image forming unit 10Y, the photoreceptor drum 12Y rotates in the clockwise direction in FIG. 1, and the charging device 14Y causes the surface of the photoreceptor drum 12Y to be charged. An electrostatic latent image in a first color (Y) is formed on the charged photoreceptor drum 12Y by the exposing device 16Y, such as a laser writing device.

The electrostatic latent image is developed using supplied toner (developer containing toner) by the developing device 18Y, and a visible toner image is formed. The toner image reaches a first transfer unit due to rotation of the photoreceptor drum 12Y, and the first transfer roll 20Y causes an electric field of a reversed polarity to operate on the toner image. Accordingly, first transfer of the toner image onto the transfer belt 100 is performed.

Similarly, a toner image in a second color (M), a toner image in a third color (C), and a toner image in a fourth color (K) are sequentially formed by the image forming units 10M, 10C, and 10K, respectively, and are superposed on the transfer belt 100. Accordingly, a multiple toner image is formed.

Then, by rotation of the transfer belt 100, the multiple toner image transferred onto the transfer belt 100 reaches a secondary transfer unit, which is an example of a transfer unit, in which the secondary transfer roll 30 is set. In the secondary transfer unit, by applying a bias at a polarity opposite the polarity of the toner image (secondary transfer voltage) between the secondary transfer roll 30 and the backup roll 28, which face each other with the transfer belt 100 therebetween, the toner image is electrostatically attracted to and transferred onto the recording paper P.

More specifically, the recording paper P is picked up one sheet by one sheet using a pickup roller (not illustrated) from a bundle of recording paper housed in a recording paper container (not illustrated), and is supplied between the transfer belt 100 and the secondary transfer roll 30 in the secondary transfer unit at a predetermined timing by a feed roll (not illustrated). The supplied recording paper P is pressed between the secondary transfer roll 30 and the backup roll 28, and the secondary transfer voltage is applied between the secondary transfer roll 30 and the backup roll 28. Accordingly, the toner image carried on the transfer belt 100 is transferred onto the recording paper P.

The recording paper P to which the toner image is transferred is conveyed by the conveying device 34 to the fixing device 36, and the toner image is fixed to be a permanent image by a pressing/heating process.

After the transfer of the multiple toner image onto the recording paper P is completed, toner remaining on the periphery of the transfer belt 100 is removed by the belt cleaner 32 arranged downstream from the secondary transfer unit. Then, the transfer belt 100 waits for the next transfer. A cleaning member (not illustrated) is arranged also in the secondary transfer roll 30, so that foreign matters, such as toner particles and paper dust, adhered to the secondary transfer roll 30 due to transfer can be removed.

In a case where a single-color image is transferred, a toner image that has been subjected to first transfer is subjected to secondary transfer in a single color and is conveyed to the fixing device 36. In a case where a multiple-color image obtained by superposing multiple colors is transferred, rotation of the transfer belt 100 and rotation of the photoreceptor drums 12Y, 12M, 12C, and 12K are made to be synchronized with each other so that toner images in individual colors coincide each other in the first transfer unit, and thus the toner images in individual colors match each other.

As described above, in the image forming apparatus 1 according to the exemplary embodiment, an image is formed on the recording paper P.

The voltage (secondary transfer voltage) to be applied to the secondary transfer roll 30 is set using a specific computation formula for each type of recording paper P in accordance with the temperature and humidity in the installation environment of the image forming apparatus 1 and the electric resistances (hereinafter, simply referred to as "resistances") of the members (the backup roll 28 and the secondary transfer roll 30) of the secondary transfer unit. The temperature and humidity in the installation environment is detected by an environment sensor (not illustrated) arranged inside the image forming apparatus 1. The resistance of the secondary transfer unit is calculated by detecting the current being made to flow when a constant voltage is being applied in a state where a toner image and recording paper do not exist in the secondary transfer unit. The type of recoding paper P is determined, for example, in accordance with the basis weight of the paper.

However, in a case where a print JOB is long, that is, in a case where printing is consecutively performed on several thousand sheets of recording paper P, the resistances of the members of the secondary transfer unit are gradually changed by the secondary transfer current being made to flow in the secondary transfer unit. The resistance of the recording paper P is also changed by the lapse of time during which the recording paper P is allowed to stand in a recording paper container. Due to the changes described above, in a case where a constant voltage is applied, the secondary transfer efficiency is changed in a print JOB. Therefore, the hue of an image printed on recording paper P differs between the early stage and later stage of the printing operation. More specifically, in a case where the resistances of the members of the secondary transfer unit gradually increase or a case where the recording paper P becomes dry and the resistance of the recording paper P gradually increases, an optimal secondary transfer voltage gradually increases. When the applied voltage is constant, the secondary transfer efficiency gradually decreases. As a result, the hue of an image is changed.

In such circumstances, by reviewing the setting of the secondary transfer voltage, that is, by measuring the temperature and humidity again and calculating the resistances of the members of the secondary transfer unit again, the productivity is reduced. In addition, setting of an optimal secondary transfer voltage cannot be performed while following changes in the resistance of the recording paper P.

A method for measuring the densities of a toner image on the transfer belt 100 before and after secondary transfer may be performed in order to achieve a constant secondary transfer efficiency (for example, the technique described in Japanese Unexamined Patent Application Publication No. 2002-323801). However, the sensitivity of measurement differs depending on the color of toner. In addition, there is a need to provide a sensor used for density detection. When only one sensor is installed, the density can be measured only at a point in the axial direction of the secondary transfer roll 30. Therefore, changes with time in the secondary transfer efficiency cannot be measured accurately.

In the image forming apparatus 1 according to the exemplary embodiment, the secondary transfer current in the process of secondary transfer is detected (monitored), and the voltage to be applied to the secondary transfer roll 30 is adjusted on the basis of the detected secondary transfer current.

In a case where secondary transfer is performed while a constant voltage is applied to the secondary transfer roll 30, the secondary transfer current varies in accordance with the resistances of the members of the secondary transfer unit, the resistance of the recording paper P, and the resistance of a toner layer. Since the resistance of the toner layer depends on the image density of a toner image existing in the secondary transfer unit, that is, the image density of a toner image to be transferred in the secondary transfer unit (hereinafter, referred to as "transfer toner image density"), the secondary transfer current varies every moment. Here, the transfer toner image density represents the average density of a toner image extending in the axial direction of the secondary transfer roll 30 in the secondary transfer unit. The secondary transfer current also varies in accordance with long-term changes in the resistances of the members and the resistance of the recording paper P.

Figure 2:
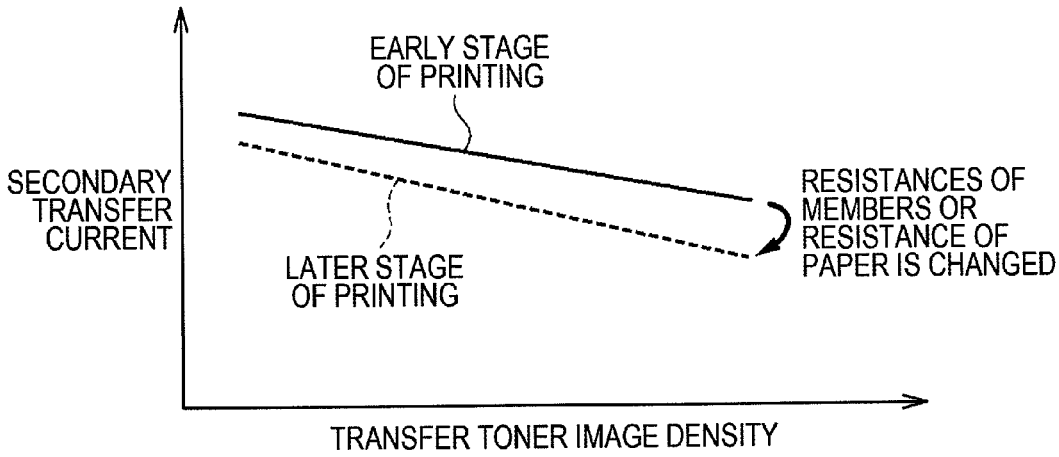
FIG. 2 is a graph illustrating the relationship between the transfer toner image density and the secondary transfer current in a case where a constant voltage is applied to a secondary transfer roll of the image forming apparatus illustrated in FIG. 1.

FIG. 2 is a graph illustrating the relationship between the transfer toner image density and the secondary transfer current in a case where a constant voltage is applied to the secondary transfer roll 30. As illustrated in FIG. 2, when the transfer toner image density increases, the secondary transfer current decreases. In addition, in a case where the resistances of the members of the secondary transfer unit or the resistance of the recording paper P increases during a period from the early stage to later stage of a printing operation, the secondary transfer current generally decreases. Thus, by obtaining the relationship between the transfer toner image density and the secondary transfer current at the time of starting a print JOB and adjusting the voltage to be applied in such a manner that changes with time in the relationship, that is, the general tendency of increase or decrease (deviation), is suppressed, a constant secondary transfer efficiency may be achieved even in a case where the resistances of the members or the resistance of the recording paper P changes in a long print JOB. Thus, the hue of an image may be prevented from being changed.

In reality, however, since it is difficult to determine whether or not a general deviation in the relationship between the transfer toner image density and the secondary transfer current is found (determine the transfer toner image density and the secondary transfer current as parameters), detection of the secondary transfer current is performed only when a toner image having a predetermined image density is being transferred and the voltage to be applied to the secondary transfer roll 30 is adjusted in accordance with the detected changes with time in the secondary transfer current.

Figure 3:
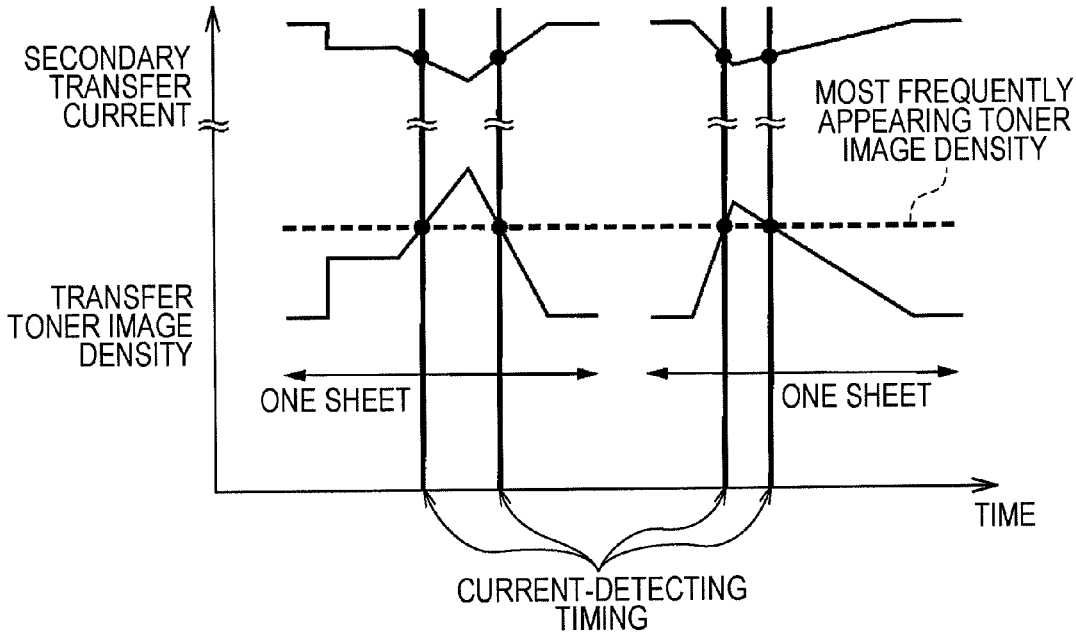
FIG. 3 is a time chart of the transfer toner image density and the secondary transfer current in a case where a constant voltage is applied to the secondary transfer roll of the image forming apparatus illustrated in FIG. 1.

FIG. 3 is a time chart illustrating the transfer toner image density and the secondary transfer current in a case where a constant voltage is applied to the secondary transfer roll 30. As illustrated in FIG. 3, the timing at which a toner image having a predetermined image density is being transferred is defined as a current-detecting timing. More specifically, the timing at which a toner image having the most frequently appearing toner image density is being transferred is defined as the current-detecting timing. The transfer toner image density that most frequently appears in a print JOB (the most frequently appearing toner image density) is calculated in advance by analyzing image information of a print JOB transmitted from the external server 46.

Figure 4:
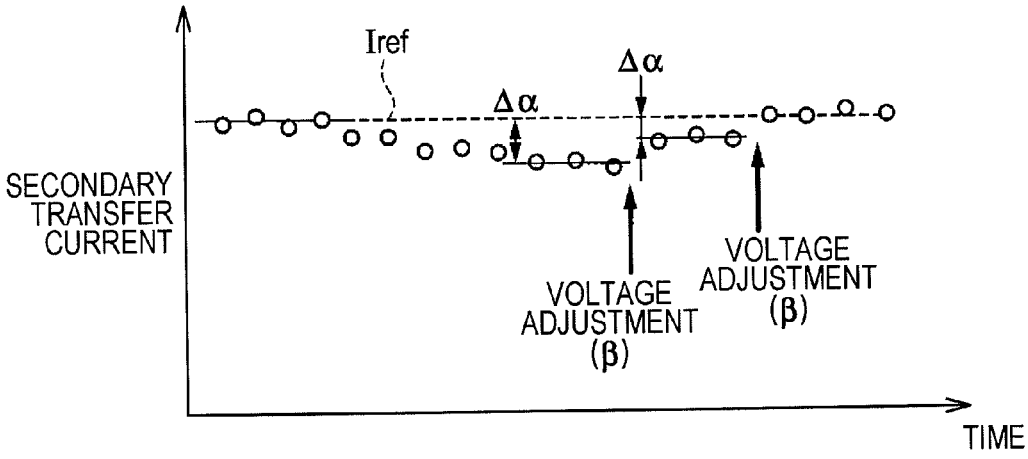
FIG. 4 is a graph illustrating changes with time in the secondary transfer current detected at a current-detecting timing illustrated in FIG. 3.

FIG. 4 is a graph illustrating changes with time in the secondary transfer current detected at the current-detecting timing illustrated in FIG. 3. The average of values of the secondary transfer current consecutively obtained in a certain number of detection operations is calculated. In a case where the difference between the average value and a reference current value (Iref) is equal to or greater than a certain threshold ($\Delta\alpha$), the voltage to be applied to the secondary transfer roll 30 is changed and adjusted by only a certain value ($\beta$). The certain value ($\beta$) is, for example, 5 V to 10 V.

Current detection is not necessarily performed for a single transfer toner image density. Current detection may be performed for two types of transfer toner image density, that is, a transfer toner image density in a higher density portion and a transfer toner image density in a lower density portion, and voltage adjustment may be performed on the basis of the transfer toner image density having a greater change with time. In addition, in a case where printing is performed on plural types of recording paper P in a single print JOB, current detection is performed for each type of recording paper P and voltage adjustment is performed only for the type of paper for which a change with time is found.

The image forming apparatus 1 according to the exemplary embodiment is configured in accordance with the technical idea described above. As described above, the image forming apparatus 1 includes the current detector 42 and the controller 44 including the secondary transfer current acquisition unit 44*a*, the print JOB acquisition unit 44*b*, and the transfer bias setting unit 44*c*.

Figure 5:
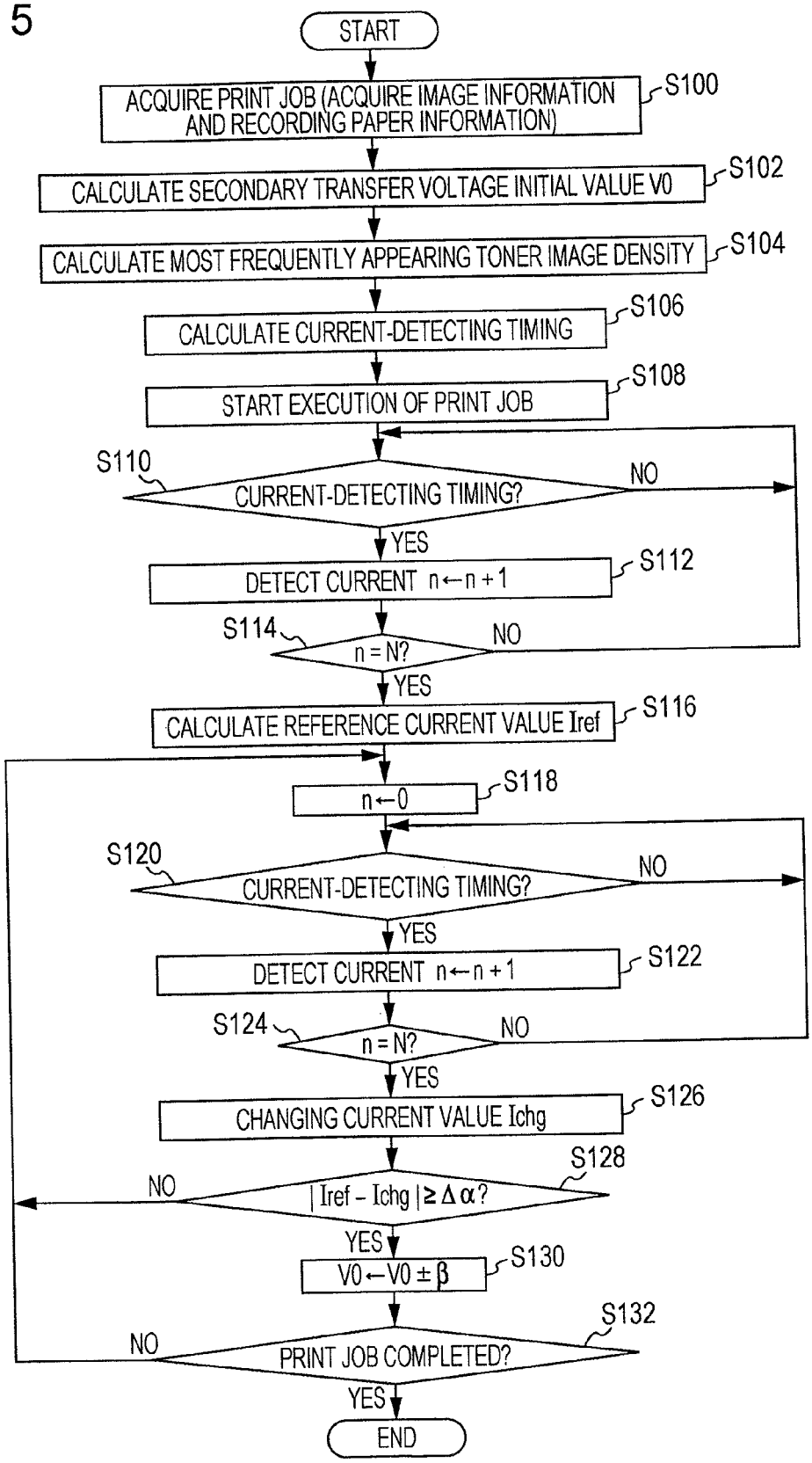
FIG. 5 is a flowchart of a process performed in accordance with a program executed by a controller of the image forming apparatus illustrated in FIG. 1.

FIG. 5 is a flowchart of a process performed in accordance with a program executed by the controller 44. In step S100, a print JOB, more specifically, information on an image to be printed and information indicating on which type of recording paper P the image is to be printed, are acquired. In step S102, an optimal transfer bias initial value (secondary transfer voltage initial value) V0 is calculated. The secondary transfer voltage initial value V0 is calculated using a specific computation formula in accordance with the temperature and humidity detected by an environment sensor, the resistances of the members of the secondary transfer unit calculated in advance, and the type of recording paper P obtained in advance.

In step S104, the most frequently appearing toner image density is calculated. The most frequently appearing toner image density is calculated on the basis of the image information included in the print JOB. In step S106, a current-detecting timing is calculated. The current-detecting timing is calculated on the basis of the time when a toner image having the most frequently appearing toner image density reaches the secondary transfer unit. In step S108, execution of the print JOB starts.

In step S110, it is determined whether or not it is the current-detecting timing. If it is determined in step S110 that it is the current-detecting timing, current detection is performed in step S112. In step S112, a control parameter n (initial value=0) is incremented by 1. The detected current value is temporarily stored in a memory (not illustrated) or the like of the controller 44.

In step S114, it is determined whether or not the control parameter n is equal to a predetermined value N (for example, 3). If the determination in step S114 is negative, the process returns to step S110. If the determination in step S114 is affirmative, the process proceeds to step S116. In step S116, the reference current value Iref is calculated. The reference current value Iref is calculated from the average of N current values obtained in N detection operations in step S112.

In step S118, the control parameter n is initialized. In step S120, it is determined whether or not it is the current-detecting timing. If it is determined in step S120 that it is the current-detecting timing, current detection is performed in step S122. In step S122, the control parameter n is incremented by 1. The detected current value is temporarily stored in the memory or the like of the controller 44.

In step S124, it is determined whether or not the control parameter n is equal to a predetermined value N (for example, 3). If the determination in step S124 is negative, the process returns to step S120. If the determination in step S124 is affirmative, the process proceeds to step S126. In step S126, a changing current value Ichg is calculated. The changing current value Ichg is calculated from the average of N current values obtained in N detection operations in step S122.

In step S128, it is determined whether or not the absolute value of a difference between the reference current value Iref and the changing current value Ichg is equal to or greater than the certain threshold $\Delta\alpha$. If the determination in step S128 is negative, the process returns to step S118. If the determination in step S128 is affirmative, the process proceeds to step S130. In step S130, a constant value $\beta$ is added to or subtracted from the secondary transfer voltage initial value V0. More specifically, if it is determined that the value obtained by subtracting the changing current value Ichg from the reference current value Iref is a positive value and that the current value has a tendency to decrease from the beginning of the print JOB, the constant value $\beta$ is added to the secondary transfer voltage initial value V0. If it is determined that the value obtained by subtracting the changing current value Ichg from the reference current value Iref is a negative value and that the current value has a tendency to increase from the beginning of the print JOB, the constant value $\beta$ is subtracted from the secondary transfer voltage initial value V0.

In step S132, it is determined whether or not the print JOB is completed. If the determination in step S132 is negative, the process returns to step S118. If the determination in step S132 is affirmative, the process is terminated.

By adjusting the secondary transfer voltage initial value V0 as described above, a variation in the secondary transfer efficiency caused by changes in the resistance of the transfer unit and the resistance of the recording medium in the process of a print JOB may be suppressed.

In addition, by detecting the secondary transfer current being made to flow when a toner image having the most frequently appearing toner image density is being transferred in the secondary transfer unit and adjusting a voltage to be applied in accordance with a change with time in the detected secondary transfer current, a variation in the secondary transfer efficiency may be suppressed with a simple configuration.

By setting the timing when a toner image having the most frequently appearing toner image density is being transferred as the current-detecting timing, the number of times current detection is performed increases. Thus, changes with time in the secondary transfer current may be understood accurately.

Since information on an image to be transferred is acquired from the external server 46 in step S100 and the most frequently appearing toner image density is calculated in advance on the basis of the acquired image information, there is no need to provide a sensor for detecting the transfer toner image density.

In a case where the print JOB acquired in step S100 indicates printing on plural types of recording paper P, control processing in the steps S102 to S130 is performed for the individual types of recording paper P. Therefore, voltage adjustment may be performed for each type of recording paper P.

By comparing the changing current value Ichg, which is the average of values of the secondary transfer current obtained by a certain number of detection operations, with the reference current value Iref and performing voltage adjustment in a case where the difference between the changing current value Ichg and the reference current value Iref is equal to or greater than the certain threshold $\Delta\alpha$, unnecessary voltage adjustment performed due to a detection variation of the secondary transfer current may be suppressed.

In the description of the image forming apparatus 1 according to the exemplary embodiment provided above, the secondary transfer unit has been explained as a transfer unit. However, the present invention is also applicable to a transfer unit of an image forming apparatus of a type in which a toner image carried on a photoreceptor drum is directly transferred onto recording paper.

In addition, in the image forming apparatus 1 according to the exemplary embodiment, recording paper P is used as a recording medium. However, an overhead projector (OHP) sheet or the like may be used as a recording medium.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier configured to carry a toner image obtained by developing an electrostatic latent image using toner;

a transfer unit configured to transfer the toner image from the image carrier onto a recording medium;

an applying unit configured to apply a voltage to the transfer unit;

a detector configured to detect a current being made to flow in the transfer unit;

an acquisition unit configured to acquire the image density of the toner image to be transferred in the transfer unit; and an adjusting unit configured to adjust a voltage to be applied to the applying unit on the basis of a change in the relationship between the current detected by the detector at the timing of transferring the image corresponding to the image density acquired by the acquisition unit to the recording medium and the image density acquired by the acquisition unit, wherein the detector is configured to detect the current being made to flow in the transfer unit when a toner image having a predetermined image density is being transferred in the transfer unit, and wherein the adjusting unit is configured to adjust the voltage to be applied to the applying unit on the basis of a change in the current detected by the detector.

2. The image forming apparatus according to claim 1, wherein the most frequently appearing image density of the image densities acquired by the acquisition unit is defined as the predetermined image density.

3. The image forming apparatus according to claim 2, wherein the acquisition unit is configured to acquire information on an image to be transferred in the transfer unit and to calculate the most frequently appearing image density on the basis of the acquired information.

4. The image forming apparatus according to claim 1, wherein the adjusting unit is configured to adjust, for each type of recording medium, the voltage to be applied to the applying unit on the basis of a change in the current detected by the detector.

5. The image forming apparatus according to claim 1, wherein the adjusting unit is configured to adjust the voltage to be applied to the applying unit on the basis of a change in the average of values of current consecutively obtained in detection operations performed a plurality of times by the detector.

6. The image forming apparatus according to claim 1, wherein the adjusting unit is configured to adjust the voltage to be applied to the applying unit in a case where a difference between the average of values of current consecutively obtained in detection operations performed a plurality of times by the detector and a reference current value is equal to or greater than a predetermined value.

7. The image forming apparatus according to claim 1, wherein the detector is configured to detect the current being made to flow in the transfer unit only when a toner image having a predetermined image density is being transferred in the transfer unit, and wherein the adjusting unit is configured to adjust the voltage to be applied to the applying unit on the basis of a change in the current detected by the detector.

8. An image forming method comprising:

carrying a toner image obtained by developing an electrostatic latent image using toner;

transferring the toner image;

applying a voltage used for transfer;

detecting a current;

acquiring the image density of the toner image to be transferred;

adjusting a voltage to be applied on the basis of a change in the relationship between the current detected at the timing of transferring the image corresponding to the image density acquired and the acquired image density; and adjusting the voltage to be applied on the basis of a change in the average of values of current consecutively detected.

9. An image forming apparatus comprising:

an image carrier configured to carry a toner image obtained by developing an electrostatic latent image using toner;

a transfer unit configured to transfer the toner image from the image carrier onto a recording medium;

an applying unit configured to apply a voltage to the transfer unit;

a detector configured to detect a current being made to flow in the transfer unit;

an acquisition unit configured to acquire the image density of the toner image to be transferred in the transfer unit; and an adjusting unit configured to adjust a voltage to be applied to the applying unit on the basis of a change in the relationship between the current detected by the detector at the timing of transferring the image corresponding to the image density acquired by the acquisition unit to the recording medium and the image density acquired by the acquisition unit, wherein the adjusting unit is configured to adjust the voltage to be applied to the applying unit on the basis of a change in the average of values of current consecutively obtained in detection operations performed a plurality of times by the detector.

10. The image forming apparatus according to claim 9, wherein the adjusting unit is configured to adjust the voltage to be applied to the applying unit in a case where a difference between the average of values of current consecutively obtained in detection operations performed a plurality of times by the detector and a reference current value is equal to or greater than a predetermined value.

* * * * *